US006088933A

United States Patent [19]

Mallalieu

[11] Patent Number: 6,088,933

[45] Date of Patent: Jul. 18, 2000

[54] DRIVE ROD AND CLUTCH DISK FOR A PAINT BRUSH AND ROLLER DRYING TOOL

[76] Inventor: David H. Mallalieu, 34 Fenway Dr., Springfield, Mass. 01119

[21] Appl. No.: 09/237,554

[22] Filed: Jan. 26, 1999

[51] Int. Cl.[7] ..... F26B 5/08

[52] U.S. Cl. ..... 34/328; 34/58; 148/529; 205/227

[58] Field of Search ..... 34/312, 328, 58, 34/59, 60, 61, 90; 148/529; 205/227, 228

[56] References Cited

U.S. PATENT DOCUMENTS

| | | | |
|---|---|---|---|
| 1,839,944 | 1/1932 | Barthels . | |
| 2,794,265 | 6/1957 | Kruger . | |
| 2,884,709 | 5/1959 | Kruger . | |
| 2,912,769 | 11/1959 | Kruger . | |
| 4,178,043 | 12/1979 | Beisch et al. | 301/37 SS |
| 4,368,811 | 1/1983 | Dubeil et al. | 192/99 |
| 4,524,514 | 6/1985 | Mallalieu et al. | 30/169 |
| 4,908,280 | 3/1990 | Omura et al. | 205/227 |
| 5,418,074 | 5/1995 | Grell | 205/227 |
| 5,453,174 | 9/1995 | Van Anglen et al. | 205/227 |
| 5,588,221 | 12/1996 | Hoeltke et al. | 34/58 |
| 5,622,162 | 4/1997 | Johansson et al. | 128/200.14 |
| 5,720,336 | 2/1998 | Strezov | 164/480 |
| 5,857,901 | 12/1979 | LaPoint | 451/113 |

*Primary Examiner*—Stephen Gravini
*Attorney, Agent, or Firm*—Ronald R. Kilponen

[57] ABSTRACT

An improved drive rod and clutch disk for a paint brush and roller cleaning tool providing the unique combination of a hardened steel clutch disk and chrome plated drive rod. Hardening virtually eliminates enlargement of the bow tie hole in the clutch disk due to wear, preventing the cross member on the end portion of the drive rod from escaping through the clutch disk bow-tie hole during the lifetime of the cleaning tool. The chrome plated spiral drive rod minimizes galling, greatly extending the useful life of the cleaning tool in the instant invention, compared to the prior art.

1 Claim, 2 Drawing Sheets

DRIVE ROD AND CLUTCH DISK FOR A PAINT BRUSH AND ROLLER DRYING TOOL

FIELD

The present version of this invention relates generally to the field of known paint brush and roller cleaning tools and more particularly to a novel and unique drive rod and clutch disk configuration for these types of cleaning tools.

BACKGROUND

This type of cleaning tool consists of a generally hollow canister within which is rotated a ball bearing supported tubular drive shaft. At the bottom of the drive shaft is a canister plug connected to a paint applicator holding device which can retain both a paint brush handle and a paint roller cover; either at one time. The top of the canister has a cap with a hole. A drive rod extends through the cap and into the tubular drive shaft contained within the canister. The drive rod has a generally spiral configuration and on the end nearest a handle is located a clutch disk. The clutch disk is mounted above the top of the tubular drive shaft and below the canister cap. The clutch disk, incorporating a bow-tie shaped hole, is rotated by the spiral drive rod. The clutch disk has a plurality of radially extending pawls. The top of the tubular drive shaft connects to a ratchet wheel having a corresponding plurality of upwardly extending triangularly shaped lugs. A cross member is incorporated on the bottom end portion of the drive rod to retain the drive rod within the canister.

As the drive rod is pushed into the canister (downstroke), the spiral drive rod rotates the clutch disk. As the clutch disk rotates, the pawls contact vertical faces of the triangularly shaped lugs on the ratchet wheel. This forces the ratchet wheel, the tubular drive shaft, the canister plug and the paint applicator holding device to rotate, thereby separating, by centrifugal force, retained paint from a paint brush or roller cover mounted thereon.

The upstroke of the drive rod rotates the clutch disk in the direction opposite its rotation during the downstroke. However, on the upstroke, the clutch disk pawls now contact sloped faces on the triangularly shaped lugs, sliding up and over the lugs without forcing counter rotation of the ratchet wheel. Thus, the spinning direction of the paint applicator holding device is always the same.

The upstroke of the drive rod is limited by a cross member at the bottom end portion of the drive rod which cannot pass through the bow-tie hole in the clutch disk.

Prior to the manufacture of paint brush and roller cleaners incorporating the blank clutch disk taught in Hoeltke et. al. U.S. Pat. No. 5,588,221, the likely first failure mode of such devices was complete separation of the drive rod and handle from the rest of the unit. This occurred, unfortunately, on the fly, i.e., while the user was pumping the handle to spin the attached paint brush or roller cover being cleaned. This created a hazardous situation in which the user, unable to instantaneously stop the cyclic thrusting of the now separated drive rod and handle, could impinge the hand holding the canister of the cleaning tool. Indeed, several injuries had been reported.

The cause of these failures was enlargement of the bow-tie hole in the unhardened steel clutch disk, due to excessive wear. This allowed the cross member at the bottom end of the spiral drive rod to escape. Various attempts were made to enhance the durability of the cleaning tool to prevent the separation of the drive rod from the canister.

Tests of cleaning tools incorporating hardened steel clutch disks, unfortunately, resulted in excessive wear of the spiral portion of the drive rods and premature failure of the devices. Hardening of both the clutch disk and the spiral portion of the drive rod resulted in galling, causing the mechanism to jam. Hoeltke's and Fischer's (U.S. Pat. No. 5,588,221) addition of a blank clutch disk, i.e. one not having pawls to engage the lugs on the ratchet wheel that drives the drive shaft assembly, when mounted in tandem with the driving clutch disk, provides a potential solution. The reason why the hole in the blank clutch disk suffers negligible wear throughout the normal life of the drive shaft assembly is because it is not being rotationally loaded as is the driving clutch disk, the former merely spinning idly when the cleaning tool is being used. The driving clutch disk, meanwhile, will suffer the same amount of wear as its predecessors sustained before the addition of the blank clutch disk, but the first failure mode will now be merely the loss of spinnability.

Still, the addition of the blank clutch disk does have drawbacks. Firstly, it could be inadvertently omitted during the assembly process, an occurrence that would go undetected until the drive rod actually separates from the canister, resulting, possibly, in injury to the user. Secondly there is the added material and production costs of the blank clutch disk to the cleaning tool. This includes the additional cost of storage and staging of the blank disk prior to assembly, as well as the labor cost of its assembly. Further, the blank clutch disk does not extend the life of the cleaning tool beyond its previous potential. In other words, the cleaning tool does not last any longer, costs more in raw materials, has increased assembly costs and complexity, and causes more storage costs from increased inventory of parts.

All of the above issues are addressed by the instant invention. The unique combination of a hardened clutch disk and a chrome plated spiral drive rod solves the problem of premature wear out of the bow tie hole in the clutch disk through which the drive rod passes and/or premature wear out of the rod. Galling is virtually eliminated. The useful life of the tool, in fact, is greatly enhanced compared to prior art. Further, the extra part required by Hoeltke et. al. (U.S. Pat. No. 5,588,221) in their solution, including its added assembly cost, is avoided, and the hardened clutch disk cannot be inadvertently omitted from the assembly without being immediately apparent. As simple as this invention seems, it was not apparent to those skilled in the art during the many years after the first spiral drive rod separations were reported up to the present day.

SUMMARY

A first object of this invention is to provide an improved clutch disk 26 having greatly increased durability compared to prior art, in order to prevent significant enlargement of the bow-tie center hole 30 due to wear and tear over the useful life of the paint brush and roller cleaner tool 10. This is accomplished by hardening the clutch disk 26.

A second object of this invention is to assure that the first failure mode of the tool 10 is not separation of the integral handle 23 and spiral drive rod 16 from the rest of the tool 10. This has occurred in prior art paint brush and roller cleaning tools due to excessive wear of the bow-tie hole 30 in the clutch disk 26 to an extent that allows the cross member 42 located at the bottom end portion 44 of spiral drive rod 16 to escape through the bow-tie hole 30. Separation of handle 23 and drive rod 16 from prior art tools, while being employed for their intended purpose, has resulted in serious injury to several individuals. Hardening the clutch disk 26 also prevents this.

A third object of this invention is to assure that the first failure mode of the cleaning tool 10 is thus a non-hazardous event, such as wear out of the upper ball bearings 14 and lower ball bearings 15, which would likely result in jamming with concomitant loss of spinnability of drive shaft 19. This is, once again, accomplished by hardening the clutch disk 26, preventing excessive wear and enlargement of the bow-tie hole 30 to an extent that would allow the cross member 42, and thus drive rod 16, to escape.

A fourth object of this invention is to extend the useful life of the tool 10 compared to prior art. This is accomplished by the combination of a hardened clutch disk 26 and chrome plated drive rod 16, the latter effectively minimizing the galling action that would otherwise occur. Common platings previously employed on prior art drive rods 16, such as zinc and nickel, are readily abraded by a hardened steel clutch disk 26, leading to premature wearout of the soft steel spiral drive rod 16. Thus, the unique combination of a hardened steel clutch disk 26 and chrome plated drive rod 16 endows the paint brush and roller cleaning tool 10 with the non-hazardous first failure mode and increased durability or longer useful life. This is accomplished with a minimum number of parts and minimal cost compared to Hoeltke's and Fischer's solution (U.S. Pat. No. 5,588,221), which unfortunately engenders the disadvantage that its "blank" clutch disk can be inadvertently omitted during the assembly process without detection. One would not become aware of this critical omission until the integral handle and drive rod actually separated from the rest of the tool as a result of enlargement of the bow-tie hole in their "soft" clutch disk. Omission of the hardened steel clutch disk in the instant invention, however, would be readily apparent upon first actuation of the tool, since, of course, it could not function.

It is yet another object of the invention to provide a device that has fewer components to assemble (compared to Hoeltke's and Fischer'solution) thereby reducing material, storage and labor costs.

For a better understanding of this invention, its operating advantages and the specific objects attained by its uses, reference should be made to the accompanying drawings and descriptive matter in which there is illustrated a preferred embodiment of this version of the invention.

DETAILED DESCRIPTION OF THE PREFERRED EMBODIMENTS

Figure 1:
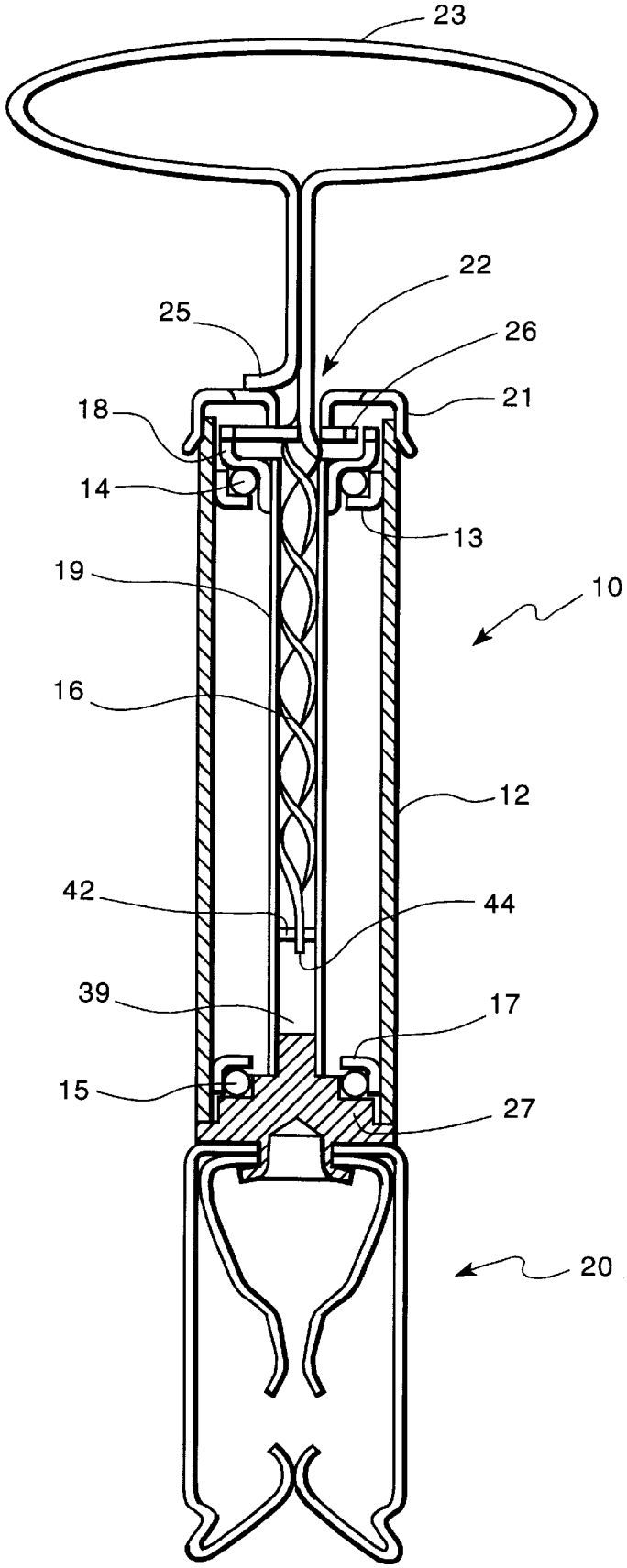
FIG. 1 shows a sectional view of the preferred embodiment of the paint brush and roller cleaning tool.

Referring to the drawings in detail wherein like elements are indicated by like numerals, there is shown in FIG. 1 a paint brush and roller cleaning tool 10 comprised in part of a canister 12 within which is a tubular drive shaft 19 having a bore 39 rotabonally mounted on ball bearing sets 14 and 15, supported by bearing cups 13 and 17, respectively, which are press fit into canister 12. Fixedly mounted to drive shaft 19 is a ratchet wheel 18 at the top end and a canister plug 27 and a paint applicator device 20 at the bottom end.

Figure 2:
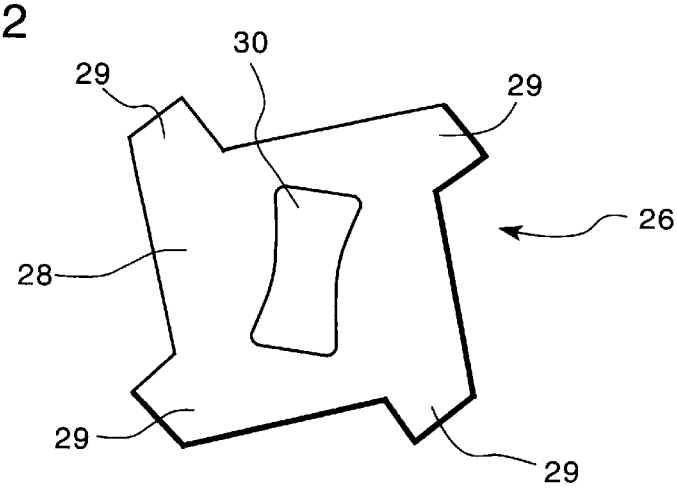
FIG. 2 shows a plan view of the clutch disk.
Figure 4:
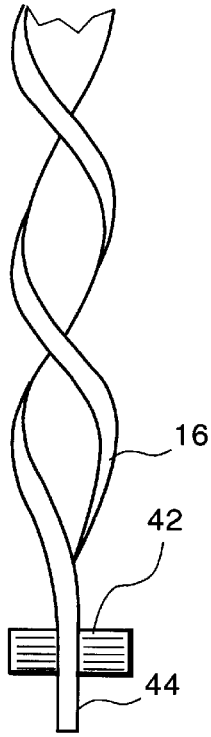
FIG. 4 shows a partial elevation view of the lower end portion of the spiral drive rod and cross member.

On the top end of canister 12 is mounted a cap 21 having a hole 22 through which passes a spiral drive rod 16, to which is integrally attached a handle 23 and a stop 25. A radially extending cross member 42 is attached to the bottom portion 44 of drive rod 16, as shown in FIG. 4. Mounted on top of ratchet wheel 18 and underneath cap 22 is a clutch disk 26, which as shown in FIG. 2 consists of a body portion 28, a plurality of radially extending pawls 29; four in this embodiment, and a bow-tie shaped center hole 30.

Figure 3:
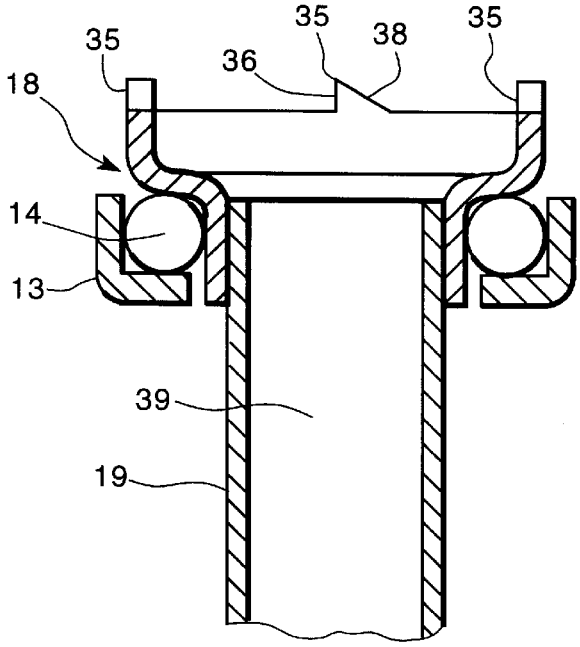
FIG. 3 shows a partial sectional view of the ratchet wheel, upper ball bearings, bearing cup and a portion of the tubular drive shaft.

As shown in FIG. 3, ratchet wheel 18 incorporates a plurality of upwardly extending, triangularly shaped lugs 35; four in this embodiment having corresponding vertical faces 36 and sloped surfaces 38.

In operation, upon assembling either a paint brush (handle) or paint roller to be cleaned (neither shown) to the paint applicator holding device 20, the user grasps the canister 12 of cleaning tool 10 in one hand and the handle 23 with the other. He or she then inserts the paint brush or roller in a suitable container, such as an empty bucket (not shown), which serves to contain the paint subsequently removed by centrifugal force imparted to the applicator holding device 20, as the user "pumps" (strokes cyclically upwardly and downwardly) the handle 23.

On the downstroke, spiral drive rod 16 passes through hole 22 in cap 21, the bow-be shaped centerhole 30 of clutch disk 26 (forcing it to rotate) and the bore 39 in drive shaft 19. The radially extending pawls 29 of clutch disk 26 contact the corresponding upwardly extending lugs 35 on their vertical faces 36, forcing ratchet wheel 18 to also rotate, as well as of course, the fixedly attached tubular drive shaft 19, canister plug 27 and paint applicator holding device 20. The downstroke terminates when integral stop 25 at the base of handle 23 impacts cap 21.

On the upstroke, spiral drive rod 16 forces clutch disk 26 to rotate in the opposite direction from that imposed by the downstroke. Ratchet wheel 18, however, due to centrifugal inertia, continues to rotate in the same direction as before because the pawls 29 of clutch disk 26 now ride up and over the sloped surfaces 38 of lugs 35 on ratchet wheel 18 rather than bear against the vertical faces 36. The upstroke of drive rod 16 is terminated when the radially extending cross member 42 at the bottom end portion 44 of drive rod 16 impacts clutch disk 26.

Cyclic stroking of handle 23, and therefore integral spiral drive rod 16, at a fast pace with one hand, while holding canister 12 steady in the other, results in a continuous spinning action that generates a powerful centrifugal force capable of separating virtually all still liquefied residual paint from the bristles of a paint brush or the cover of a paint roller, whichever is attached at the time.

The improvement to the paint brush and roller cleaning tool 10 involves heat treating the clutch disk 26 to a predetermined hardness, preferably above Rockwell 40C, and the chrome plating of the drive rod 16.

These improvements assure that the first failure mode of the cleaning tool 10 will not be separation of drive rod 16, and that the useful life of tool 10 will be considerably extended compared to prior art.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. An improved drive rod and clutch disk for a paint applicator cleaning tool designed to free said applicator of paint by centrifugal force, said drive rod having a handle and a stop flange at one end, a spiral portion, and a radially extending cross member at the end portion, and said clutch disk comprising a body having a bow-tie hole and a plurality of pawls projecting radially from said body, said spiral drive rod passing through said bow-tie hole, said clutch disk being rotationally responsive to cyclic thrusting of said spiral drive rod, and said clutch disk readily slidable on said spiral drive rod, and said drive rod being responsive to cyclic pushing and pulling of said handle, and said flange limiting the distance that said drive rod can be pushed in one direction, while said radially extending cross member limits the distance that said drive rod can be pulled in an opposite direction, said cross member restraining said drive rod from escaping said cleaning tool; and said cleaning tool additionally comprising a canister within which is mounted a bearing supported, freely rotatable tubular drive shaft having attached at one end a ratchet wheel and at the other end attached a canister plug and paint applicator holding device, said canister having a cap on the end opposite the canister plug and paint applicator holding device, said cap having a hole through which said spiral drive rod passes, said ratchet wheel having a plurality of lugs adapted to a singular direction of rotation when engaged by said clutch disk pawls, said lugs not being rotationally responsive to said pawls when said clutch disk is rotated in the opposite direction, said tubular drive shaft providing a bore to receive said spiral drive rod portion and cross member, said bore having sufficient length for the full cyclic stroking distances of said drive rod as limited by said stop flange in one direction and said cross member in the other, the improvement comprising:

chrome plating the spiral drive rod, and hardening a heat treatable steel clutch disk.

* * * * *